US008545341B2

(12) United States Patent
Choi

(10) Patent No.: US 8,545,341 B2
(45) Date of Patent: Oct. 1, 2013

(54) EIGHT-DIRECTIONAL CONTROLLED DYNAMIC PLATE BASED ON ONE-POINT

(75) Inventor: Song Hwan Choi, Daejeon (KR)

(73) Assignee: RD-Tek Co., Ltd., Daejeon (KR)

( * ) Notice: Subject to any disclaimer, the term of this patent is extended or adjusted under 35 U.S.C. 154(b) by 222 days.

(21) Appl. No.: 13/133,926

(22) PCT Filed: Dec. 17, 2009

(86) PCT No.: PCT/KR2009/007577
§ 371 (c)(1),
(2), (4) Date: Jun. 9, 2011

(87) PCT Pub. No.: WO2010/071375
PCT Pub. Date: Jun. 24, 2010

(65) Prior Publication Data

US 2011/0244978 A1 Oct. 6, 2011

(30) Foreign Application Priority Data

Dec. 17, 2008 (KR) ..... 10-2008-0128549

(51) Int. Cl.
*A63B 57/00* (2006.01)

(52) U.S. Cl.
USPC ..... 473/279; 473/278; 403/53; 108/4

(58) Field of Classification Search
USPC ..... 473/279, 278; 403/53, 57, 74, 93, 403/399; 108/4, 7, 8
See application file for complete search history.

(56) References Cited

U.S. PATENT DOCUMENTS

| | | | | | |
|---|---|---|---|---|---|
| 14,750 | A * | 4/1856 | Burk | 74/41 |
| 3,563,553 | A * | 2/1971 | Baldwin et al. | 473/164 |
| 3,753,452 | A * | 8/1973 | Zebley | 139/311 |
| 5,683,306 | A * | 11/1997 | Tait et al. | 473/279 |
| 6,179,724 | B1 * | 1/2001 | Yang et al. | 473/279 |
| 6,663,498 | B2 * | 12/2003 | Stipan | 473/279 |
| 8,336,957 | B2 * | 12/2012 | Roy et al. | 297/163 |
| 2010/0056289 | A1 * | 3/2010 | Zhou et al. | 473/279 |

FOREIGN PATENT DOCUMENTS

| | | | |
|---|---|---|---|
| JP | 2003-154044 | A | 5/2003 |
| KR | 10-48961 | B1 | 9/1991 |
| KR | 20-0175850 | Y1 | 3/2000 |
| KR | 10-0306568 | B1 | 9/2001 |
| KR | 2002-0044130 | A | 6/2002 |
| KR | 10-0358416 | B1 | 10/2002 |
| KR | 20-0347739 | Y1 | 4/2004 |
| KR | 10-0489422 | B1 | 5/2005 |

OTHER PUBLICATIONS

International Search Report for International Application No. PCT/KR2009/007577.

* cited by examiner

*Primary Examiner* — Dmitry Suhol
*Assistant Examiner* — Carl V Larsen
(74) *Attorney, Agent, or Firm* — LRK Patent Law Firm

(57) ABSTRACT

An eight-directional controlled dynamic plate based on one-point allows a central portion of a forward side of the dynamic plate with feet of the golfer being positioned thereon to be connected in one-point to the swing plate body, and the dynamic plate to be inclined in eight directions including a forward, a rearward, a leftward, and a rightward direction and four edge directions, so that the dynamic plate is to be positioned corresponding to an inclination surface and an inclination angle of actual outdoor golf course.

5 Claims, 10 Drawing Sheets

EIGHT-DIRECTIONAL CONTROLLED DYNAMIC PLATE BASED ON ONE-POINT

CROSS REFERENCE TO RELATED APPLICATION

This application is a National Stage of International Application No. PCT/KR2009/007577 filed Dec. 17, 2009, claiming priority based on Korean Patent Application No. 10-2008-0128549 filed Dec. 17, 2008, the content of which is incorporated herein by reference in its entirety.

TECHNICAL FIELD

The present invention relates to a swing plate in screen golf system and, more particularly, to an eight-directional controlled dynamic plate based on one-point for a golf swing practice that permits a forward, a backward, a leftward and a rightward portion, and each four edge portions in a foot plate with feet of a golfer being positioned thereon to be moved upward/downward in a perpendicular direction so that the foot plate is inclined corresponding to ground surface conditions of an actual outdoor golf course upon practicing the golf swing.

BACKGROUND ART

Generally, there have been golf practice courts for practicing the golf swing and the like in order to enable performing the playing in actual golf course more delicately.

When practicing the golf swing in such golf practice courts, the golf practice in the golf practice courts has a big difference from the playing in an actual outdoor golf course since it is done in an environmental atmosphere different from the actual outdoor golf course, as well as an effect of the golf practice cannot be exhibited in the actual golf course.

Recently, there has proposed a screen golf system which provides an indoor golf practice court with environmental atmosphere similar to the actual golf course in order to remove problems mentioned above.

Herein, the screen golf system includes a main computer 110 for executing a golf simulator program, a projector 120 connected to the main computer 110 for projecting images of surrounding environments of the actual outdoor golf course, a screen 130 for displaying the image projected from the projector 120, and a swing plate 140 with feet of the golfer being positioned thereon.

Herein, the swing plate 140 of the screen golf system 100 is connected to the main computer for supplying golf balls and is constructed with a swing plate body 141 having a plurality of sensors for sensing a moving angle, rotation velocity and rotation location of the club head and a foot plate 143 with the feet of the golfer being positioned thereon.

It further comprises a camera 150 which takes pictures of images of swing state when the golfer hits the golf ball and then provides it to the golfer back.

The operation of the screen golf system is performed by which the golfer stands up on the foot plate of the swing plate, grips a suitable golf club such as a driver, iron, wood and putter, and then hits or puts the golf ball supplied via a golf ball supplier toward the screen.

After the sensor senses the moving angle, the rotation velocity and rotation location of the club head when the golfer hits and puts the golf ball to cause them to be analyzed and computed by the main computer, the surrounding images such as the moving image and a lie of the golf ball analyzed and computed are displayed on the screen.

In such generic screen golf system, since the foot plate is consisted of plate-like body, he must do the golf practice only with the flat ground condition and thus cannot do the enough and satisfactory golf practice as compared with the actual golf playing having terrain deformation such as an inclined surface or an inclined angle in actual golf course.

There has been proposed a swing plate which is capable of controlling the inclination degree in forward, backward, leftward and rightward directions for providing the screen golf system with golf practice conditions similar to those of actual outdoor golf course in order to remove above-mentioned problem.

Korean Patent Registration No. 10-0358416 has disclosed an inclination control device of a golf swing practice mat which causes a hydraulic cylinder to be ascended and descended by a control panel and an oil unit and causes a support plate of bottom surface and an inclination control plate of top surface to be connected to each other by the hydraulic cylinder.

Korean Patent Publication No. 2002-0044130 has disclosed a foot plate for golf practice which is mounted with four supports having spherical groove formed in a bottom surface of the foot plate and mounted with semi-spherical piston head contacted in-point to a spherical groove of each of the supports in end portions of piston of four hydraulic jacks controlled by a control unit respectively to support the foot plate so that the foot plate may be controlled in various inclined directions and inclined angles.

Further, Korean Patent No. 20-0175850 has disclosed a foot plate for golf practice which is capable of controlling the inclination degree which has a cylinder attached to each edge between a top plate and a bottom plate and connecting two pairs of cylinders faced diagonally with each other by means of a hose to make inside of both cylinders communicating to each other and has a valve attached to a middle of the two hoses, so that the valve can be open and closed simultaneously by a lever exposed over the top plate.

Further, Korean Patent No. 10-48961 has disclosed a foot plate for golf swing practice court which is constructed with a support plate, control box provided in a one side of a top surface of the support plate, a forward, backward, leftward and rightward operated hydraulic motor mounted in forward and rearward side of the top surface of the support plate having a screw axis operated by the control box, a hydraulic cylinder connected to one side of the hydraulic motor by connecting member, a hydraulic control unit formed in the inside of the hydraulic cylinder connected to a screw bolt tightened to the screw axis of the hydraulic motor, a hydraulic cylinder which is connected to an inclination control plate and supplied with oil pressure via a hydraulic hose formed on both sides of the hydraulic cylinder operated upward and downward to cause it to be operated upward and downward, and an inclination control plate formed on a top portion of the hydraulic cylinder to control the inclination.

However, the above-mentioned foot plate according to prior art have a problem of increasing cost of product since the inclination control apparatus of the foot plate is of hydraulic type and a plurality of inclination control devices must be attached to the foot plate.

Further, there are problems in that a plurality of hydraulic cylinders is operated to cause the inclination control plate located in a top portion to be controlled so that each hydraulic cylinder cannot be controlled simultaneously; the inclination control angle of the inclination control plate is not fine; and inclination control velocity of the foot plate is substantially too slow to apply it for the swing practice court.

Subsequently, it is difficult to provide the golf practice environments similar to those of the actual outdoor golf course.

DISCLOSURE OF INVENTION

Technical Problem

An embodiment of the present invention is directed to providing an eight-directional controlled dynamic plate based on one-point which enables the foot plate to be located corresponding to an inclined surface or an inclined angle of actual outdoor golf course since a central portion in forward side of the foot plate with a golfer being positioned thereon in a swing plate of a screen golf system is connected in one-point to a swing plate body to cause the foot plate to be inclined in eight directions including a forward, a backward, a leftward and a rightward direction and four edge directions based on the one-point.

Further, another embodiment of the present invention is directed to providing an eight-directional controlled dynamic plate based on one-point which is capable of controlling the fine inclination of the foot plate by causing the foot plate to be inclined in eight directions by means of two inclination control devices provided on the inclination control plate.

Further, another embodiment of the present invention is directed to providing an eight-directional controlled dynamic plate based on one-point which is capable of doing the golf practice while feeling sensation of presence in the actual outdoor golf course by controlling the inclination of the foot plate similarly to the ground surface inclination according to surrounding environments of the actual outdoor golf course to provide the inclination condition similar to that of the actual outdoor golf course.

Solution to Problem

To achieve the object of the present invention, the present invention provides an eight-directional controlled dynamic plate based on one-point that is provided on a swing plate 8, which is applied to screen golf system 70 and includes a swing plate body 7, the eight-directional controlled dynamic plate based on one-point comprises: an inclination control plate 5 with feet of a golfer being positioned thereon; a support plate 3 provided in a bottom portion of the inclination control plate; main inclination control devices 10, 10' coupled to coupling groove 5*b* formed on both sides in a top surface of the support plate 3 to cause the inclination control plate 5 to be inclined in eight directions including a forward, a rearward, a leftward and a rightward direction and four edge directions; an auxiliary inclination control device 30 provided in a forward side in the top surface of the support plate 3 and connected in one-point to a central portion of the swing plate body 7 in a cross axis manner while being moved in combination with the inclination operation of the inclination control plate 5 and; and a control unit 50 controllably connected to the main inclination control devices 10, 10' in one side in the top surface of the support plate 3.

Herein, the main inclination control device 10, 10' comprises a housing 11 having a circular plate-shaped rotation member 11*a*, a support unit 12 connected to a rearward side of the housing 11, a rotation control member 13 connected to a central axis 11*c* of the rotation member 11*a* to cause the rotation member 11*a* to be rotated in forward and reverse directions, a pair of inclination control members 14 provided in both sides of the rotation member 11*a* respectively and having a rotation piece 14*a* protruded into one side of circumference edge respectively, a connecting member 15 having at least one connecting pin 15*a* formed in branch and having a mounting hole penetrated through an end portion of a width direction to cause it to be inserted between rotation pieces 14*a* of each of the inclination control member 14, an inclination control pole 16 inserted into the mounting hole 15*b* of the connecting member 15 and having an inclination control piece 16*a* having an inclination control hole 16*b* in an end portion, and an inclination control support 17 having a support pole penetrated through the inclination control hole 16*a* of the inclination control piece 16*a* to cause the inclination control pole 16 to be sliding-moved and connected to a side surface of the inclination control plate 5.

Preferably, the support unit comprises a connecting pole 12*a* which is inserted into a penetration hole 11*b* formed in a longitudinal direction of the housing 11 and a supporting member 12*b* which is connected to a central axis of an end portion of the connecting pole 12*a*.

More preferably, the rotation control member 13 comprises a bearing 13*a* coupled to a central axis 11*c* of the rotation member 11*a*, a rotation connection member 13*b* coupled to face to the central axis of the rotation member 11*a*, and a rotary motor 13*c* connected to a side surface of the rotation connection member 13*b* to cause the rotation member 11*a* to be rotated.

More preferably, the auxiliary inclination control device 30 comprises one pair of inclined plates 31, 31' which is separated from each other by a certain distance in forward and rearward directions of the support plate 3, a main connecting pole 32 which is provided in a center portion of each of the inclined plates 31, 31' for connecting the inclined plates 31, 31' to each other, a pivoting member 34 having a coupling hole 35 penetrated through a center portion in a longitudinal direction to cause the main connecting pole 32 to be inserted and having a rotation pole 36 protruded into both sides, a holding member 37 having the rotation poles 36 of the pivoting member 34 to be connected rotatively and provided in the support plate 3, and an auxiliary connecting pole 33 provided at least one on both sides of the main connecting pole 32 for connecting each inclined plates 31, 31' to each other.

More preferably, the control unit 50 is connected to a main computer 71 executing a golf simulation program for receiving data related to an inclination surface or an inclination angle according to a lie of a golf ball and controls the main inclination control devices 10, 10' to be corresponded to the received data to control an inclination of the inclination control plate 5.

Advantageous Effects of Invention

As described above, the present invention has advantages in that the foot plate can be inclined in eight directions including forward, rearward, leftward and rightward direction and four edge directions to be corresponded to ground surface condition of actual outdoor golf course to allow the golfer to do the golf practice with the inclination condition similar to that of the actual outdoor golf course, since the foot plate is connected in one point to the swing plate body and forward, rearward, leftward and rightward portions and four edge portions of the foot plate are moved upward/downward in a perpendicular direction.

According to the present invention, since the dynamic plate can be inclined in eight directions by means of two inclination control devices provided in both sides of the inclination control plate with the feet of golfer being positioned thereon, it is possible to reduce product cost, as well as control the inclination of the dynamic plate finely using each inclination control device.

Further, it is possible to feel sensation of presence in actual outdoor golf course by allowing the foot plate of the screen golf system to be inclined in various directions to control the inclination of the foot plate, and thus to provide a golfer with the golf environment similar to that of the actual outdoor golf course when doing the golf practice so that the golfer can practice the golf posture to cope with the actual golf play and adapt for various situations which can be happened in the actual outdoor golf course.

Further, the structure of the dynamic plate according to the present invention can be simplified to allow the product cost to be reduced, as well as the maintenance and use thereof are simple to make it possible to replace only existing foot plate of the swing plate with the dynamic plate upon applying for the screen golf system.

MODE FOR THE INVENTION

The advantages, features and aspects of the invention will become apparent from the following description of the embodiments with reference to the accompanying drawings, which is set forth hereinafter.

Figure 1:
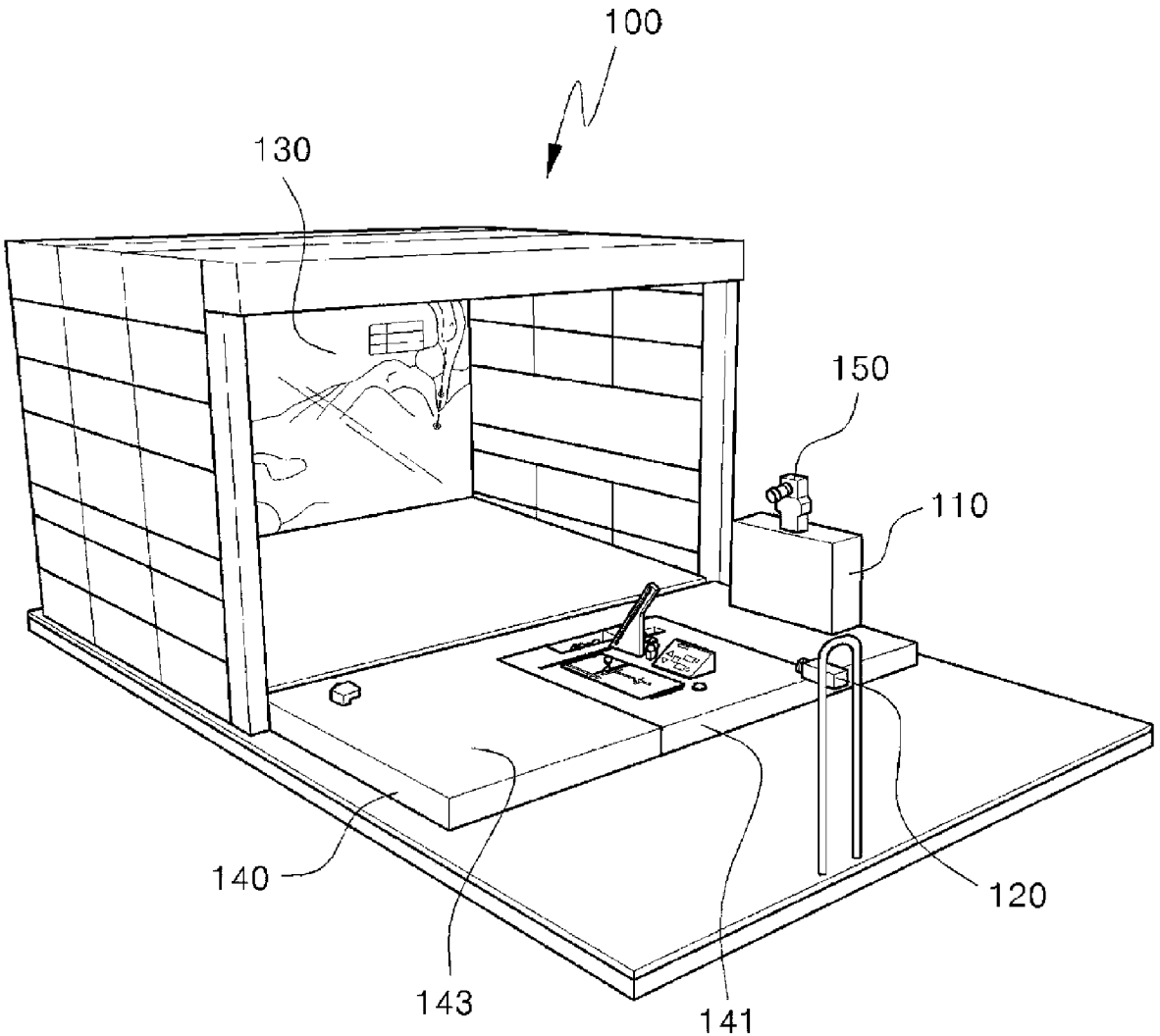
FIG. 1 is a schematic drawing showing a generic screen golf system.
Figure 2:
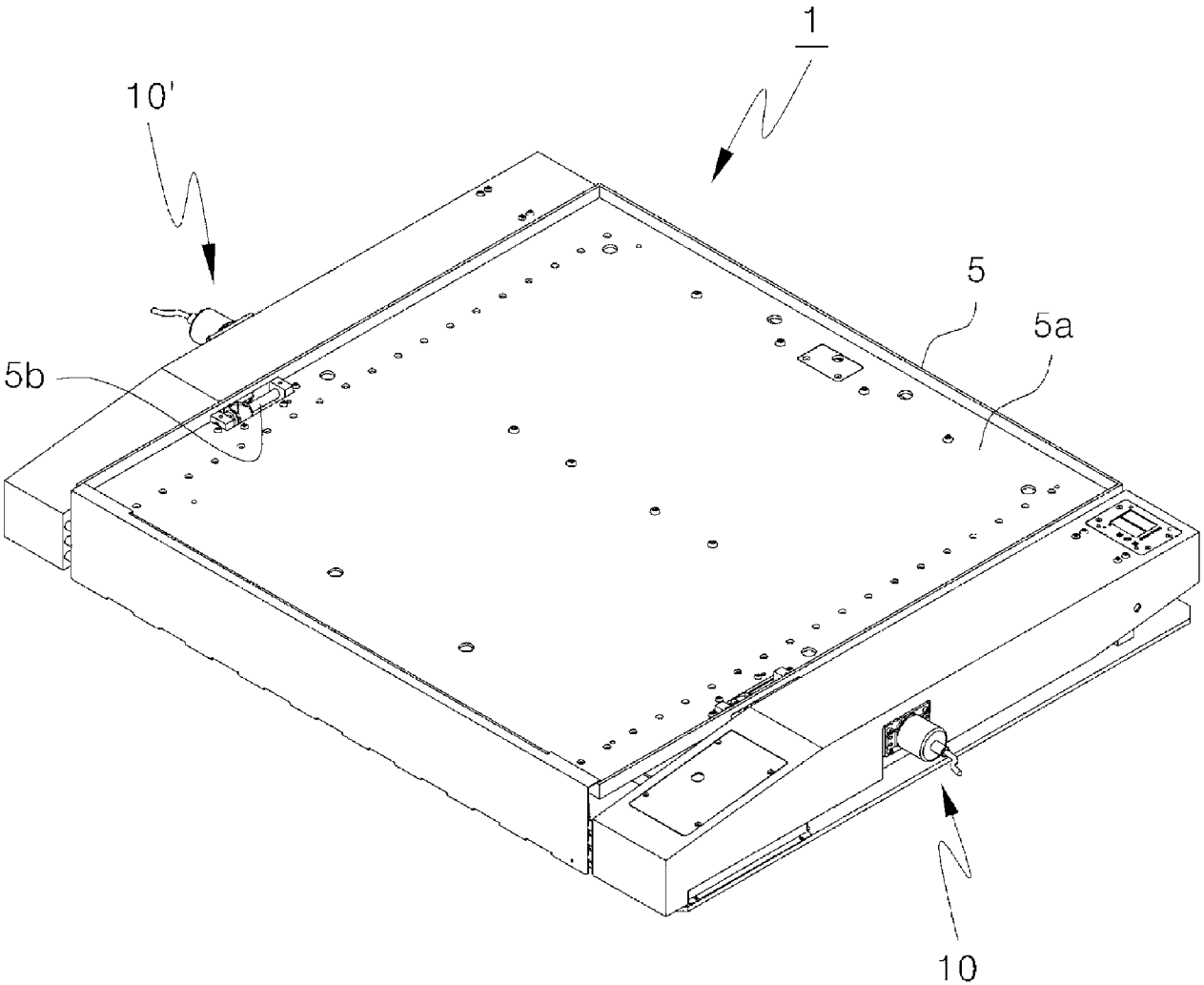
FIG. 2 is a schematic perspective view showing an eight-directional controlled dynamic plate based on one-point according to the present invention.
Figure 3:
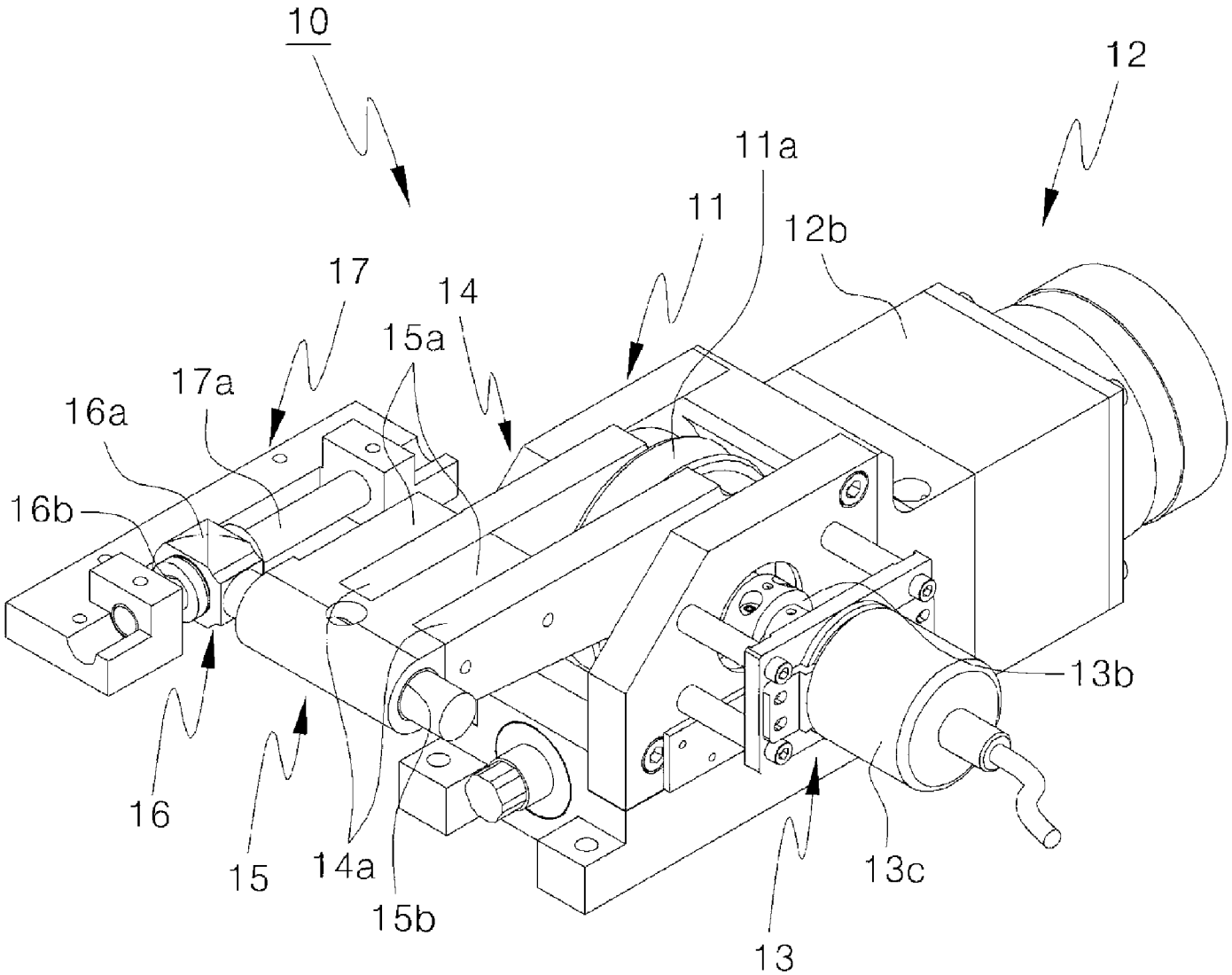
FIG. 3 is a schematic perspective view showing a main inclination control device of the eight-directional controlled dynamic plate based on one-point according to the present invention.
Figure 4:
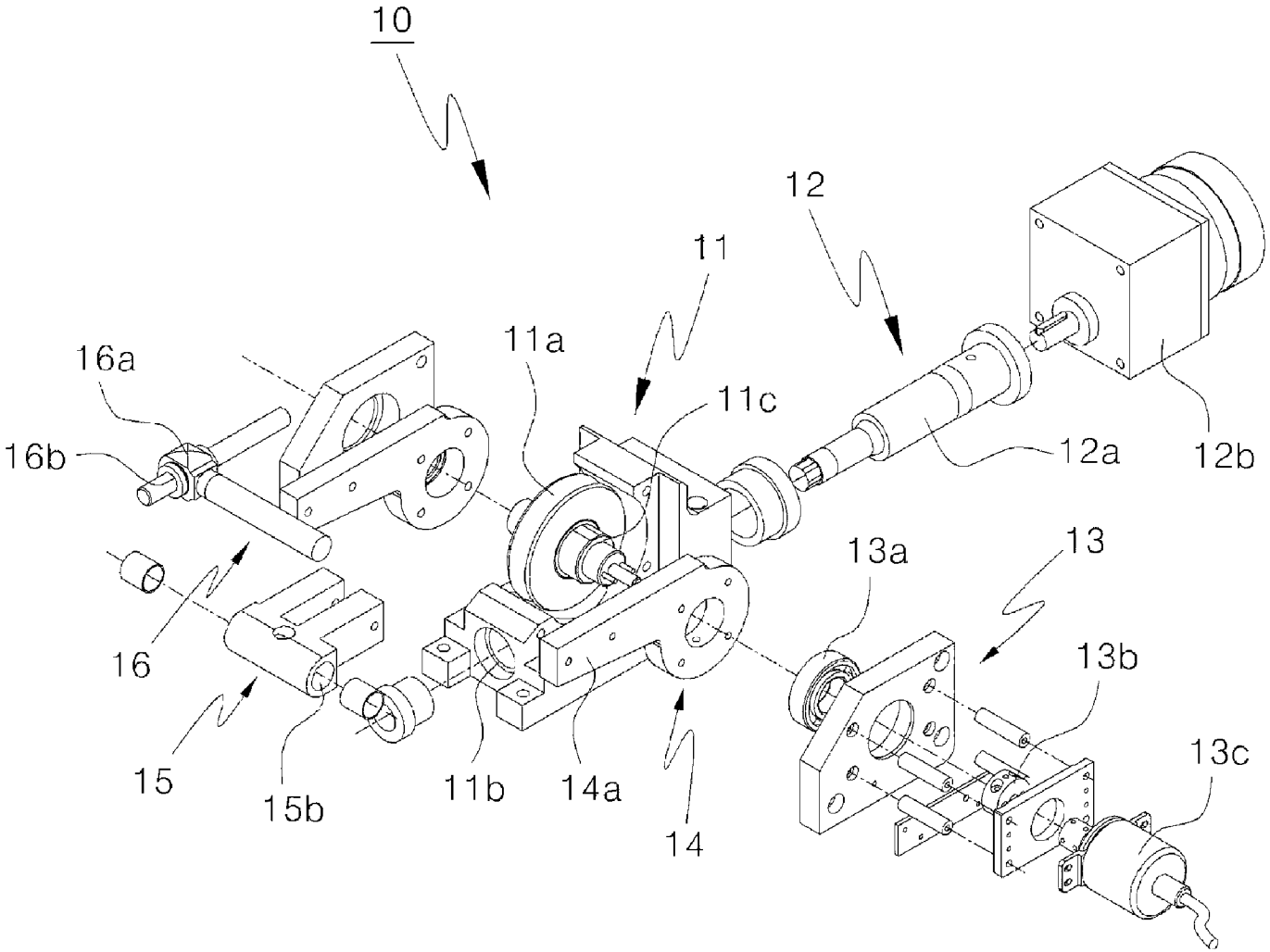
FIG. 4 is a schematic disassembled perspective view showing a main inclination control device of the eight-directional controlled dynamic plate based on one-point according to the present invention.
Figure 5:
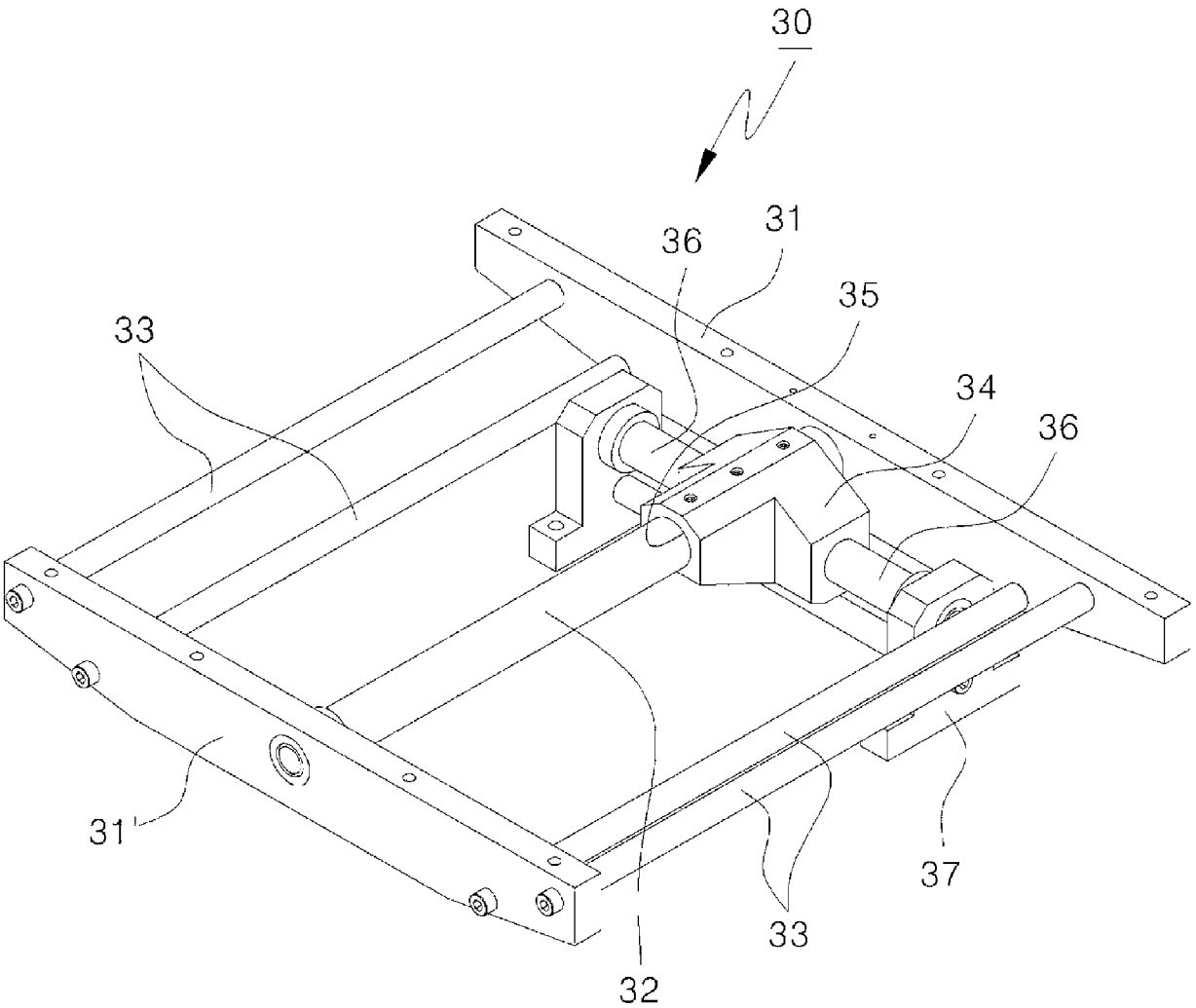
FIG. 5 is a schematic perspective view showing an auxiliary inclination control device of the eight-directional controlled dynamic plate based on one-point according to the present invention.
Figure 6:
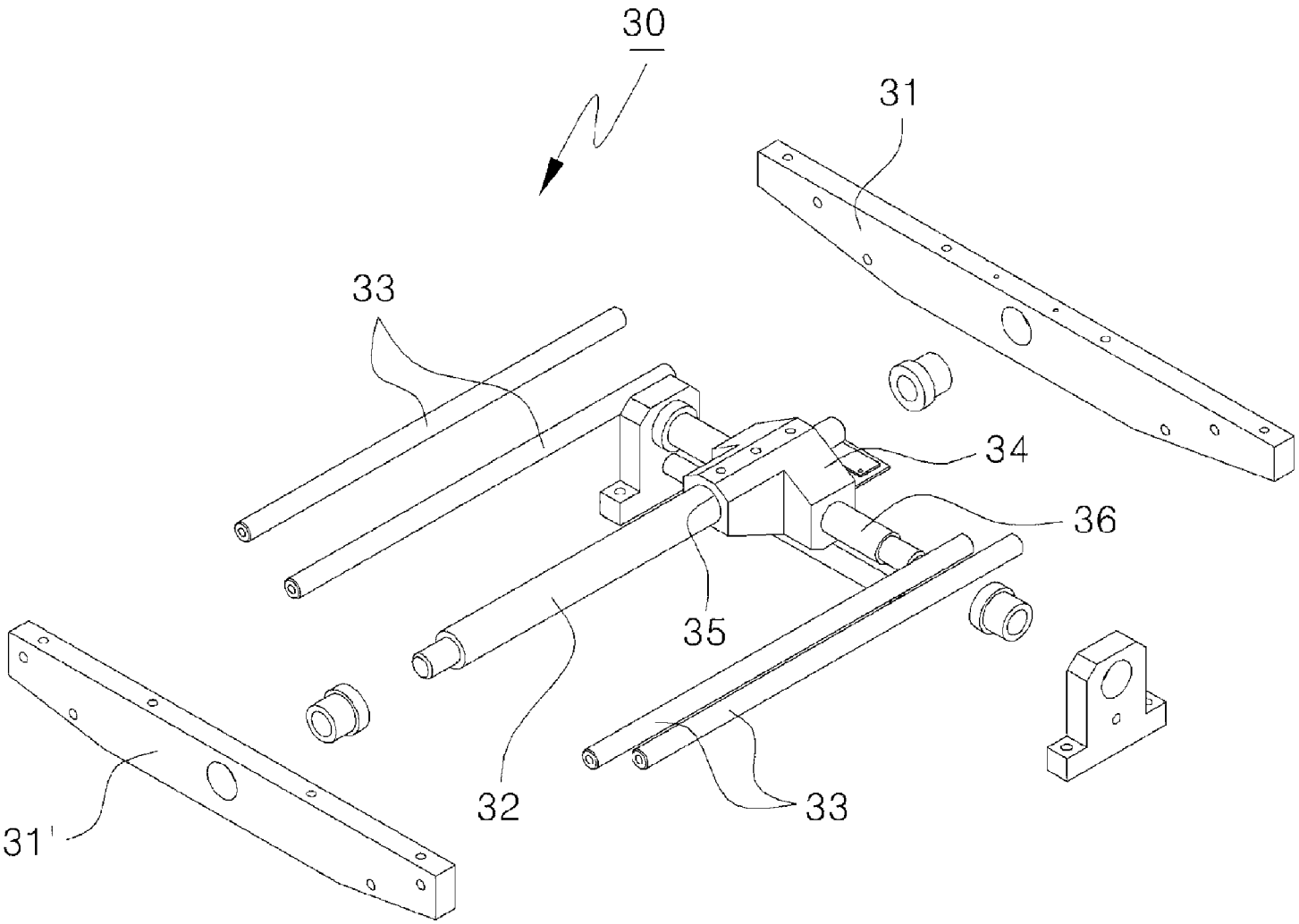
FIG. 6 is a schematic disassembled perspective view showing an auxiliary inclination control device of the eight-directional controlled dynamic plate based on one-point according to the present invention.
Figure 7:
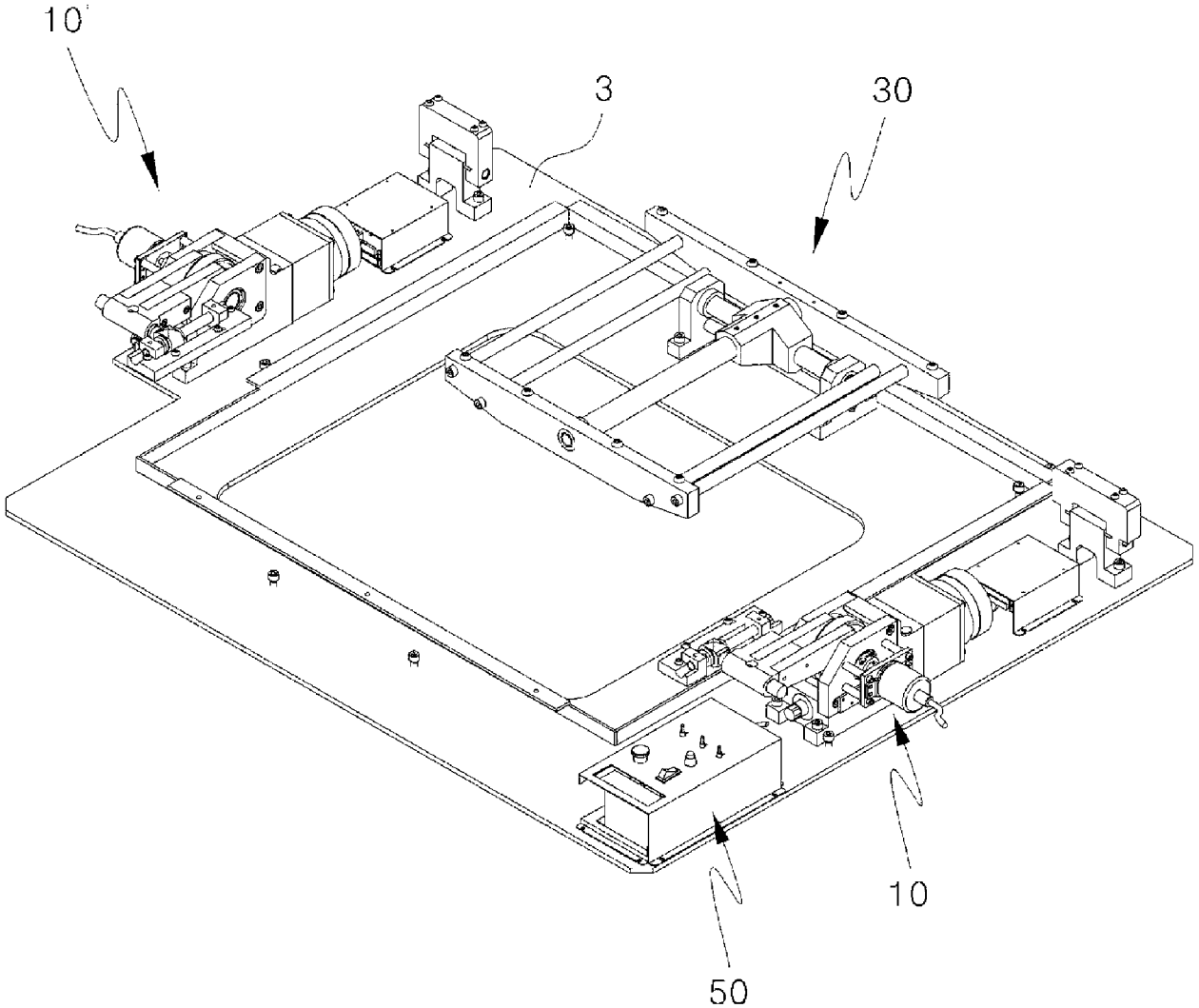
FIG. 7 is a schematic perspective view showing that the main inclination control device and the auxiliary inclination control device are provided in the eight-directional controlled dynamic plate based on one-point according to the present invention.
Figure 8:
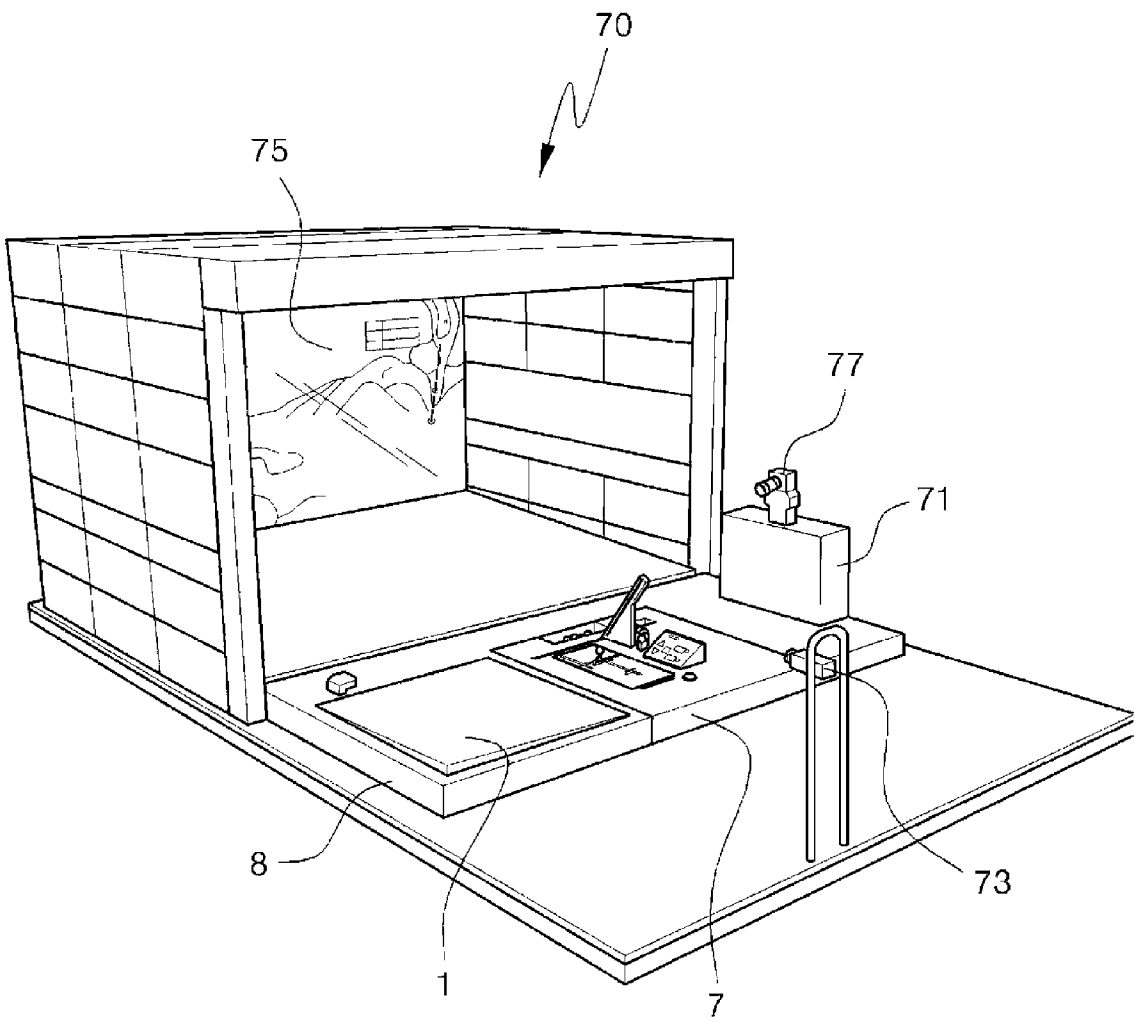
FIG. 8 is a schematic perspective showing that the eight-directional controlled dynamic plate based on one-point according to the present invention is applied for a screen golf system.
Figure 9:
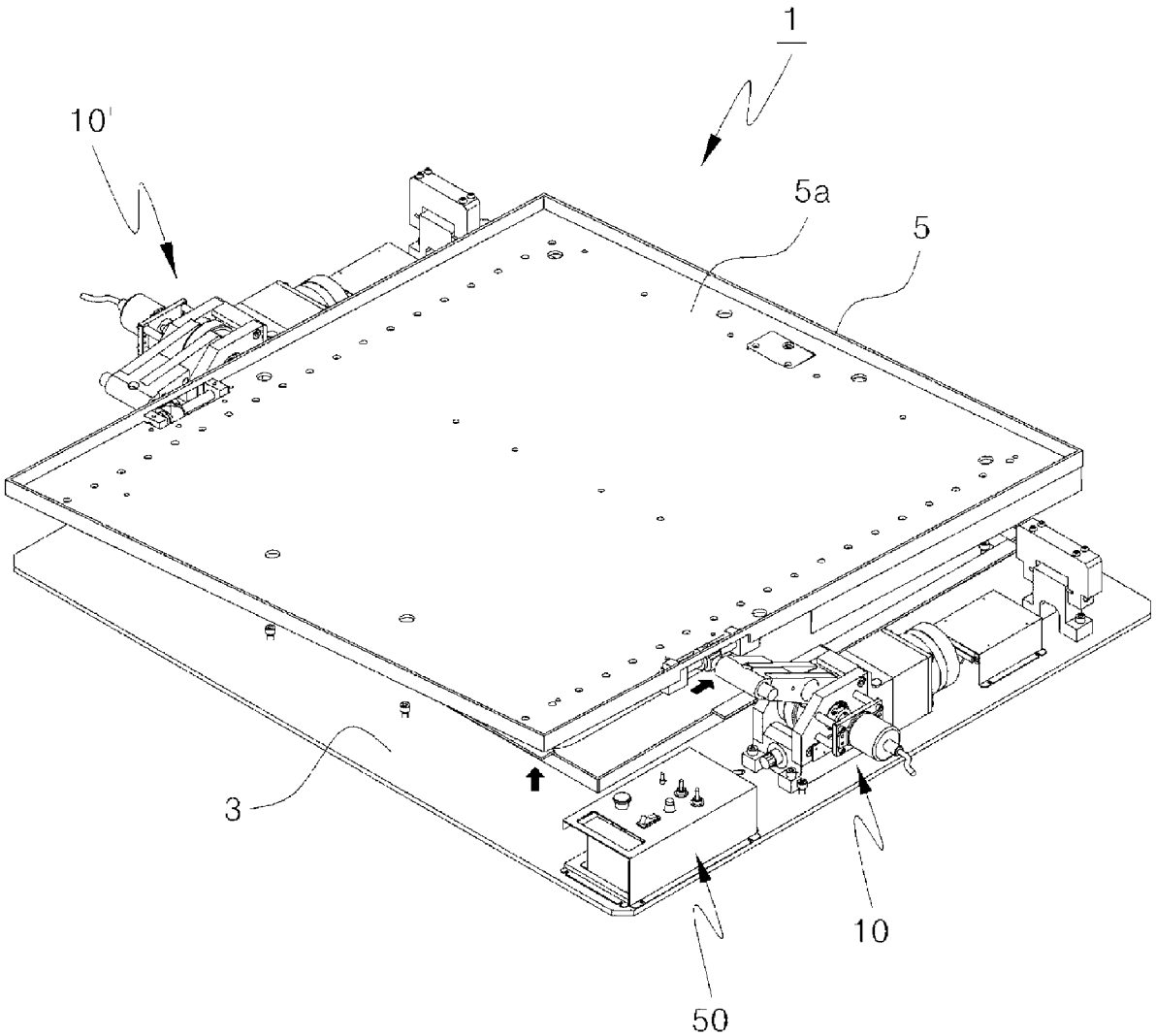
FIG. 9 is a schematic perspective view showing how the eight-directional controlled dynamic plate based on one-point according to the present invention is operated.
Figure 10:
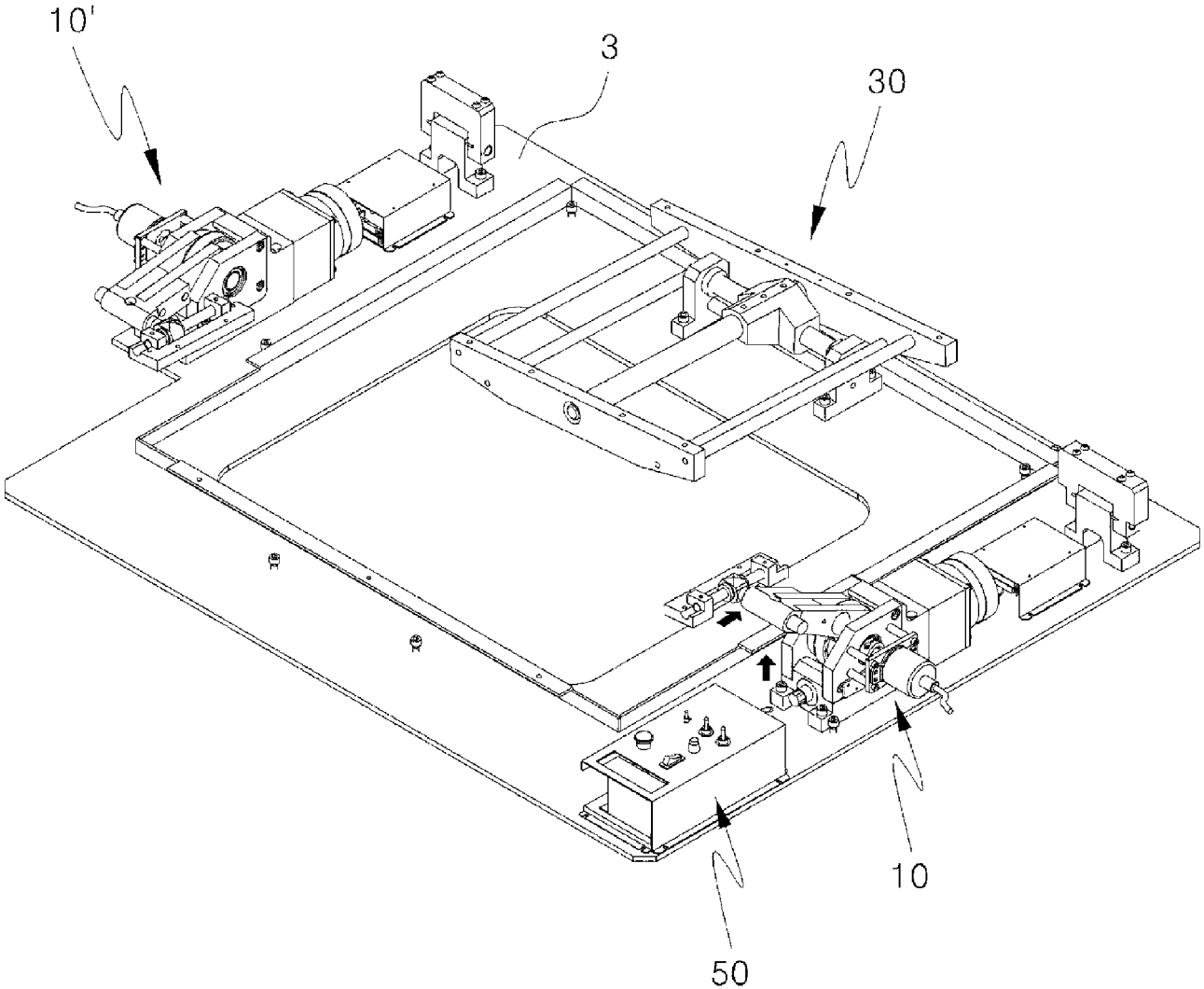
FIG. 10 is a schematic perspective view showing how the main inclination control device and the auxiliary inclination control device are operated in the directional control dynamic plate of eight directions based on one-point according to the present invention.

FIG. 2 is a schematic perspective view showing an eight-directional controlled dynamic plate based on one-point according to the present invention; FIG. 3 is a schematic perspective view showing a main inclination control device of the eight-directional controlled dynamic plate based on one-point according to the present invention; FIG. 4 is a schematic disassembled perspective view showing a main inclination control device of the eight-directional controlled dynamic plate based on one-point according to the present invention; FIG. 5 is a schematic perspective view showing an auxiliary inclination control device of the eight-directional controlled dynamic plate based on one-point according to the present invention; FIG. 6 is a schematic disassembled perspective view showing an auxiliary inclination control device of the eight-directional controlled dynamic plate based on one-point according to the present invention; FIG. 7 is a schematic perspective view showing that the main inclination control device and the auxiliary inclination control device are provided in the eight-directional controlled dynamic plate based on one-point according to the present invention; FIG. 8 is a schematic perspective showing that the eight-directional controlled dynamic plate based on one-point according to the present invention is applied for a screen golf system; FIG. 9 is a schematic perspective view showing how the eight-directional controlled dynamic plate based on one-point according to the present invention is operated; and FIG. 10 is a schematic perspective view showing how the main inclination control device and the auxiliary inclination control device are operated in the directional control dynamic plate of eight directions based on one-point according to the present invention.

As shown in the drawings, the eight-directional controlled dynamic plate based on one-point according to the present invention is applied for generic screen golf system 70 which is consisted of a main computer 71 for executing a golf simulation program, a projector 73 connected to the main computer 71 for projecting an image of a actual outdoor golf course, a screen 75 for displaying the images projected from the projector 73, a swing plate 8 on which a golfer does the golf practice and a camera 77.

The swing plate 8 is supplied with golf balls via a golf ball supplier (not shown) and structured with a swing plate body 7 having a plurality of sensors (not shown) for sensing a moving angle, rotation velocity and rotation position of the golf club head (not shown) and a foot plate 1 with feet of the golfer being positioned thereon.

Herein, the eight-directional controlled dynamic plate based on one-point applied for the screen golf system 70 according to the present invention is structured with main inclination control devices 10, 10' which are provided in both sides of the top portion of the support plate 3 and connected to each of both sides of the inclination control plate 5 which is inclined when being located in a top portion of the support plate 3, an auxiliary inclination control device 30 which is provided in a forward side of a top portion of the support plate 3 and connected to a forward side of a bottom portion of the inclination control plate 5, and a control unit 50 which is provided in one side of a top portion of the support plate 3 and controllably connected to the main inclination control devices 10, 10'.

The main inclination control devices 10, 10' are structured with a housing 11 having a circular plate-shaped rotation member 11*a*, a support unit 12 connected to a rearward side of the housing 11, a rotation control member 13 connected to a central axis 11*c* of the rotation member 11*a* to cause it to be rotated in forward and reverse directions, a pair of inclination control members 14 provided on both sides of the rotation member 11*a* and having a rotation piece 14*a* protruded into one side of outer circumference, a connecting member 15 having at least one connecting pin 15*a* formed in branch and having a mounting hole 15*b* penetrated through an end portion in a width direction to be inserted between each inclination control pieces 16*a* in the one pair of inclination control members 14, an inclination control pole 16 inserted into a mounting hole 15*b* of the connecting member 15 and having an inclination control piece 16*a* having an inclination control hole 16*b* on an end portion, a support pole 17*a* provided to penetrate through the inclination control hole 16*b* of the inclination control piece 16*a* for causing the inclination control pole 16 to be sliding moved, and an inclination control support 17 connected to a side surface of the inclination control plate 5.

Herein, the support unit 12 is constructed with a connecting pole 12*a* inserted into a penetration hole 11*b* formed in a longitudinal direction of the housing 11 and a support member 12*b* connected to a central axis of an end portion of the connecting pole 12*a*.

The rotation control member 13 is constructed with a bearing 13*a* coupled to a central axis 11*c* of the rotation member 11*a*, a rotation connection member 13*b* coupled to be faced with the central axis 11*c* of the rotation member 11*a*, and a rotary motor 13*c* connected to the central axis 11*c* of the rotation member 11*a* while coming in contact with a side of the rotation connection member 13*b* to rotate the rotation member 11*a*.

When the rotary motor 13*c* of the rotation control member 13 is driven, the rotation member 11*a* connected to the rotation connection member 13*b* of the rotary motor 13*c* is rotated in forward and reverse directions and the one pair of inclination control members 14 provided in each of both sides of the rotation member 11*a* and having the rotation piece 14*a* protruded into the circumference edge is rotated, so that the inclination control pole 16 connected to the rotation piece 14*a* of the inclination control member 14 and connected by the inclination control hole 16*b* to the support pole 17*a* of the inclination control support 17 connected to the inclination control plate 5 is moved vertically and at the same time is sliding moved along the support pole 17*a* coupled on the inclination control hole 16*b*.

Subsequently, any one main inclination control device 10, 10' connected to each of both sides of the inclination control plate 5 among main inclination control devices 10, 10' is operated or main inclination control devices 10, 10' are operated simultaneously to cause the inclination control pole 16 to be moved vertically and to be sliding moved on the support pole 17*a* of the inclination control support 17, so that it is possible to allow the inclination control plate 5 to be inclined in eight directions including a forward, a backward, a leftward and a rightward direction, and four edge directions with a center of the support plate 3.

The auxiliary inclination control device 30 is constructed with one pair of inclined plates 31, 31' which is connected to a forward side on a bottom surface of the inclination control plate 5 and separated from each other by a certain distance in forward and rearward directions of the support plate 3, a main connecting pole 32 which is provided in a center portion of the one pair of inclined plates 31, 31' for connecting the inclined plates 31, 31' to each other, a pivoting member 34 having a coupling hole 35 penetrated through a center portion in longitudinal direction to cause the main connecting pole 32 to be inserted and rotated along inner circumference edge thereof and having rotation poles 36 protruded on both side, a holding member 37 held in the support plate 3 while allowing each end of the rotation pole 36 of the pivoting member 34 to be connected to be rotated, and an auxiliary connecting pole 33 interposed between the inclined plates 31, 31' to cause the inclined plates 31, 31' to be connected to each other and provided at least one on both sides of the main connecting pole 32.

If any one main inclination control device 10, 10' of main inclination control devices 10, 10' which are provided in both sides of the inclination control plate 5 is operated so that the inclination control plate 5 is inclined in a horizontal direction, the main connecting pole 32 connecting the inclined plates 31, 31' to each other is rotated in forward/reverse directions within the coupling hole 35 of the pivoting member 34 while each of the inclined plates 31, 31' provided in a bottom surface of the inclination control plate 5 is inclined corresponding to the inclination control plate 5.

If the main inclination control devices 10, 10 provided in both sides of the inclination control plate 5 is operated simultaneously so that the inclination control plate 5 is inclined in forward and reverse directions, the rotation pole 36 protruded into each of both sides of the pivoting member 34 is rotated on the coupling member 37 while each of the inclined plates 31, 31' provided in a bottom surface of the inclination control plate 5 is inclined corresponding to the inclination control plate 5 so that any one inclined plate 31 located in front side of the support plate 3 is considered as a basis and thus the other inclined plate 31' is inclined at a certain angle to cause one of the inclined plates 31, 31' to be connected in one-point to the swing plate body 7.

Any one main inclination control device 10 is rotated differently from the other inclination control device 10' to cause the inclination control plate 5 to be inclined in the edge direction when the main inclination control devices 10, 10' provided in each of both sides of the inclination control plate 5 are operated simultaneously, the main connecting pole 32 connecting the inclination plates 31, 31' to each other is rotated in forward and reverse directions within the coupling hole 35 of the pivoting member 34 and the rotation poles 36 protruded into both sides of the pivoting member 34 respectively are rotated on the holding member 37 while each inclined plate 31, 31' provided in bottom surface of the inclination control plate 5 has the edge portion inclined into one side according to the inclination control plate 5, thereby causing the edge portion of the inclination control plate 5 to be inclined at a certain angle.

Herein, the inclination control plate 5 has a lawn setting groove 5*a* with indoor artificial lawn being positioned thereon for providing surrounding environments similar to those of actual outdoor golf course, and is connected to the main inclination control devices 10, 10' and the auxiliary inclination control device 30 provided in both sides and front side of the support plate 3 respectively.

At this time, the inclination control plate 5 has coupling groove 5*b* of the shape corresponding to that of the inclination control support 17 formed to allow the inclination control support 17 of each main inclination control device 10, 10' to be connected to both sides thereof.

The control unit 50 is electrically connected to the main inclination control devices 10, 10' provided in the support plate 3 when being provided in one side of the top portion of the support plate 3 and also connected to a main computer 71 for executing a golf simulation program.

If the golfer swings the golf club to hit the golf ball upon doing the golf practice via such screen golf system 70, the computer 71 computes data according to an inclination surface or an inclination angle of the place where the golf ball is located from the image projected on the screen 75 and provides it to the control unit 50 of the dynamic plate 1 and then the control unit 50 controls each of the main inclination control devices 10, 10' to be corresponded to the inclination surface or the inclination angle to cause the inclination control plate 5 to be inclined in a certain direction.

It is possible to present an inclination condition similar to that of the actual outdoor golf course by controlling the inclination of the dynamic plate 1 to be corresponded to the ground inclination of the surrounding environment in the actual outdoor golf course, thereby making it possible to do the golf practice while feeling sensation of presence in the actual outdoor golf course.

Hereinafter, the operation of the screen golf system 70 for which the eight-directional controlled dynamic plate based on one-point according to the present invention is applied will be described referring to FIG. 9 and FIG. 10.

First, the golfer operates the golf simulation program via the main computer 71 of the screen golf system 70 for doing the golf practice.

If the golf simulation program is operated via the main computer 71, the image of the actual outdoor golf course is projected via the projection connected to the main computer 71 and then displayed on the screen 75.

As described above, if the image of the actual outdoor golf course is projected on the screen 75, the golfer swings the golf club to strike the golf ball supplied from the golf ball supplier.

At this time, if the golfer strikes the golf ball in the screen golf system 70, a swing speed, a swing trajectory, a swing angle and a swing position of the club head are sensed by the sensor and then a traveling direction, a traveling distance of the golf ball struck by the golf club and a lie of the golf ball after being traveled are determined.

As described above, when the golfer strikes the golf ball, the main computer 71 provides data of a ground surface inclination information predetermined in the golf simulation program according to the lie of the golf ball displayed on the screen 75 and transmits it to the control unit 50 of the dynamic plate 1, the control unit 50 controls the inclination of the plate 1 in accordance with the ground surface inclination information transmitted.

More specifically, the main computer 71 transmits data of the predetermined ground surface inclination information to the control unit 50 of the dynamic plate 1 in accordance with the lie of the golf ball displayed on the screen 75 and the control unit 50 controls each of the main inclination control devices 10, 10' connected to each of both sides of the inclination control plate 5 to cause the inclination control plate 5 to be inclined according to the predetermined ground surface inclination information.

At this time, if the inclination control plate 5 is to be inclined so that left side may be positioned higher than right side, the main inclination control device 10' connected to left side of the inclination control plate 5 among the main inclination control devices 10, 10' connected to both sides of the inclination control plate is operated so that the left side of the inclination control plate 5 is moved upward to allow the left side to be higher positioned than the right side of the inclination control plate 5; and if the inclination control plate 5 is to be inclined so that right side may be higher positioned than left side, the main inclination control device 10 connected to right side of the inclination control plate 5 among the main inclination control devices 10, 10' connected to both sides of the inclination control plate is operated so that the right side of the inclination control plate 5 is moved upward to allow the right side to be higher positioned than the left side of the inclination control plate 5.

Herein, if the inclination control plate 5 is to be inclined so that left side may be higher positioned than right side, the main inclination control device 10' connected to the left side of the inclination control plate 5 is operated so that the rotary motor 13*c* of the rotation control member 13 is operated and thus the rotation member 11*a* connected to the rotary motor 13*c* by the rotation connection member 13*b* is reversely rotated.

At this time, when the rotation member 11*a* is reversely rotated, the inclination control member 14 provided in each of both sides of the rotation member 11*a* is reversely rotated similarly to the rotation member 11*a* and at the same time the rotation piece 14*a* protruded into circumference edge of the each inclination control member 13 is pivoted in upward direction and the connection member 15 connected to the rotation piece 14*a* by multiple connection pins 15*a* formed in branch is moved in upward direction, and the inclination control pole 16 inserted into the mounting hole 15*b* of the connection member 15 and the inclination support 17 connected by the support pole 17*a* to the inclination control hole 16*b* formed in end portion of the inclination control pole 16 are moved vertically, which results that the inclination control plate 5 connected to the inclination control support 17 is inclined to cause a left side to be higher positioned than right side.

At this time, the auxiliary inclination control device 30 connected to a bottom surface in front side of the inclination control plate 5 by one pair of inclination plate 31, 31' is operated to be corresponded to the inclination degree of the inclination control plate 5. More specifically, if the main inclination control device 10' provided in left side of the inclination control plate 5 is operated so that the inclination control plate is inclined to cause left side to be higher positioned than right side, each inclination plate 31, 31' of the auxiliary inclination control device 30 is inclined to be corresponded to the inclination control plate 5 and the main connecting pole 32 inserted into the coupling hole 35 of the pivoting member 34 while being connected two inclination plates 31, 31' to each other is operated to be corresponded to the inclination of the inclination control plate 5 while being pivoted into a direction which the inclination control plate 5 is inclined corresponding to the inclination degree of the inclination control plate 5.

The inclination control plate 5 can be inclined to cause the left side to be higher positioned than the right side via the operation mentioned above. If the inclination control plate 5 is to be inclined to cause the right side to be higher positioned than the left side, the main inclination control device 10 connected to the right side of the inclination control plate 5 among two main inclination control devices 10, 10' is operated so that the inclination control plate 5 is inclined to cause the right side to be higher positioned than the left side.

Meanwhile, if the inclination control plate 5 is to be inclined into forward or rearward directions, the main inclination control devices 10, 10' connected to each of both sides of the inclination control plate 5 are operated so that a rearward side of the inclination control plate 5 is moved upward or downward to cause the inclination control plate 5 to be inclined forwardly/reversely Herein, if the main inclination control devices 10, 10' connected to each of both sides of the inclination control plate 5 are operated so that the inclination control plate 5 may be inclined to cause the rearward side to be higher positioned than the forward side, the rotary motor 13*c* of the rotation control member 13 of the main inclination control devices 10, 10' provided in left side of the inclination control plate 5 is operated so that the rotation member 11*a* connected to the rotary motor 13*c* by the rotation connection member 13*b* may be rotated reversely and the rotary motor 13*c* of the rotation control member 13 of the main inclination control devices 10, 10' provided in the rightward side of the inclination control plate 5 is operated so that the rotation member 11*a* connected to the rotary motor 13*c* by the rotation connection member 13*b* is rotated forwardly.

By allowing each rotation member 11*a* of the main inclination control device 10' provided in left side and the main inclination control device 10 in right side of the inclination control plate 5 to be rotated reversely/forwardly, the rotation piece 14*a* of each inclination control device provided in both sides of each rotation member 11*a* is pivoted in a upward direction to cause the inclination control pole 16 connected to each rotation piece 14*a* by the connection member 15 to be moved upward and the inclination control support 17 connected to the inclination control plate 5 is moved in a vertical direction to cause the rearward side of the inclination control plate 5 to be moved vertically in the upward direction, which results that the inclination control plate 5 can be inclined to cause the rearward side to be higher positioned than the forward side.

At this time, the auxiliary inclination control device 30 provided in bottom surface of forward side of the inclination control plate 5 and having one pair of inclination plates 31, 31' is operated to be corresponded to the inclination degree of the inclination control plate 5. That is, if each inclination control device 10, 10' provided in both sides of the inclination control plate 5 is operated so that the inclination control plate 5 is inclined to cause the rearward side to be higher positioned than the forward side, the inclination control plate 5 is inclined into forward side while the inclination plate 31' located in the rearward side of the bottom surface of the inclination control plate 5 among the inclination plates 31, 31' of the auxiliary inclination control device 30 is pivoted in upward direction with a center of the pivoting member 34.

In order to cause the inclination control plate 5 to be inclined into forward side, the dynamic plate 1 is preferably connected in a cross axis manner to make it possible to be pivoted in vertical and horizontal direction while being connected in one point to the swing plate body 7.

It is possible to incline the inclination control plate 5 to cause the rearward side to be higher positioned than the forward side as mentioned above. If the forward side of the inclination control plate 5 is to be higher positioned than the rearward side, each main inclination control device 10, 10' is operated so that the rearward side of the inclination control plate is lower positioned than the forward side to allow the forward side to be higher positioned than the rearward side of the inclination control plate 5.

Meanwhile, if the inclination control plate 5 is inclined in four edge directions of the inclination control plate 5, any one main inclination control device 10', 10 connected to left side or right side among the main inclination control devices 10, 10' connected to both sides of the inclination control plate 5 respectively is operated so that the inclination control hole 16*b* formed in the inclination control piece 16*a* of the inclination control pole 16 in the main inclination control device 10, 10' is moved on the support pole 17*a* of the inclination control support 17 connected to the inclination control plate 5 to cause the edge portions of the inclination control plate 5 to be inclined.

At this time, if the edge portion of the inclination control plate 5 is to be inclined at a certain angle, only the main inclination control device 10' but the main inclination control device 10 of which the inclination control hole 16*b* is moving on the support pole 17*a* is auxiliary operated to make it possible to control the inclination degree of the inclination control plate 5.

As mentioned above, if the edge portion of the inclination control plate 5 is to be inclined at a certain angle, any one inclination control device is operated so that the rotary motor 13*c* of the rotation control member 13 is driven and thus the rotation member 11*a* connected to the rotation motor 13*c* is rotated forwardly/reversely.

As such, as the rotation member 11*a* is rotated, the rotation piece 14*a* of the inclination control member 14 is pivoted in the upward direction, the inclination control pole 16 connected by the connection member 15 connected to the rotation piece 14*a* is moved in the upward direction and the inclination control hole 16*b* is sliding moved on the support pole 17*a*, which results that the edge portion of the inclination control plate 5 is moved in upward direction to allow the inclination control plate 5 to be inclined.

Even at this time, the auxiliary inclination control device 30 connected to bottom portion of the inclination control plate 5 is inclined to be corresponded to the inclination degree of the inclination control plate 5 and the rotation pole 36 is rotated on the holding member 37 while the main connecting pole 32 is rotated with a center of the pivoting member 34, which results that the edge portions of the inclination control plate 5 can be inclined.

As mentioned above, it is possible to control the inclination control plate 5 in eight directions including a forward, a rearward, a leftward, and a rightward direction and four edge directions, as well as to incline the inclination control plate 5, since the forward side of the inclination control plate 5 with feet of the golfer being positioned thereon is connected to the swing plate body 7 in a cross axis manner, and the main inclination control devices 10, 10' are provided in both sides of the inclination control plate 5 and the auxiliary inclination control device 30 is provided in forward side of the inclination control plate 5.

Further, it is possible to provide the inclination surface or the inclination angle similar to those of the actual outdoor golf course by connecting the forward side of the inclination control plate 5 to the swing plate body 7 based on one-point, and thus for the golfer to do the golf practice while feeling sensation of presence in actual outdoor golf course by presenting the inclination conditions similar to those of the actual outdoor golf course.

While the present invention has been described with respect to the specific embodiments, it will be apparent to those skilled in the art that various changes and modifications may be made without departing from the spirit and scope of the invention as defined in the following claims.

The invention claimed is:

1. An eight-directional controlled dynamic plate based on one-point that is provided on a swing plate which is applied to a screen golf system and includes a swing plate body, the eight-directional controlled dynamic plate based on one-point, comprising:

an inclination control plate configured for the feet of a golfer to be positioned thereon;

a support plate provided in a bottom portion of the inclination control plate;

main inclination control devices coupled to coupling grooves formed on two opposite sides in a top surface of the support plate to cause the inclination control plate to be inclined in eight directions including a forward, a rearward, a leftward and a rightward direction and four diagonal directions towards four corners thereof;

an auxiliary inclination control device provided in a forward side in the top surface of the support plate and connected in one-point to a central portion of the swing plate body in a cross axis manner while being moved in combination with the inclination operation of the inclination control plate; and a control unit controllably connected to the main inclination control devices in one side in the top surface of the support plate, wherein the main inclination control device comprises:

a housing having a circular plate-shaped rotation member, a support unit connected to a rearward side of the housing, a rotation control member connected to a central axis of the rotation member to cause the rotation member to be rotated in forward and reverse directions, a pair of inclination control members provided in both sides of the rotation member respectively and having a rotation piece protruded into one side of circumference edge respectively, a connecting member having at least one connecting pin formed in branch and having a mounting hole penetrated through an end portion of a width direction to cause it to be inserted between rotation pieces of each of the inclination control member, an inclination control pole inserted into the mounting hole of the connecting member and having an inclination control piece having an inclination control hole in an end portion, and an inclination control support having a support pole penetrated through the inclination control hole of the inclination control piece to cause the inclination control pole to be sliding-moved and connected to a side surface of the inclination control plate.

2. The eight-directional controlled dynamic plate based on one-point of claim 1, wherein the support unit comprises a connecting pole which is inserted into a penetration hole formed in a longitudinal direction of the housing and a supporting member which is connected to a central axis of an end portion of the connecting pole.

3. The eight-directional controlled dynamic plate based on one-point of claim 1, wherein the rotation control member comprises a bearing coupled to a central axis of the rotation member, a rotation connection member coupled to face to the central axis of the rotation member, and a rotary motor connected to a side surface of the rotation connection member to cause the rotation member to be rotated.

4. The eight-directional controlled dynamic plate based on one-point of claim 1, wherein the auxiliary inclination control device comprises one pair of inclined plates which is separated from each other by a certain distance in forward and rearward directions of the support plate, a main connecting pole which is provided in a center portion of each of the inclined plates for connecting the inclined plates to each other, a pivoting member having a coupling hole penetrated through a center portion in a longitudinal direction to cause the main connecting pole to be inserted and having a rotation pole protruded into both sides, a holding member having the rotation poles of the pivoting member to be connected rotatively and provided in the support plate, and at least two auxiliary connecting poles, wherein at least one auxiliary connecting pole is provided on each side of the main connecting pole for connecting each inclined plates to each other.

5. The eight-directional controlled dynamic plate based on one-point of claim 1, wherein the control unit is connected to a main computer executing a golf simulation program for receiving data related to an inclination surface or an inclination angle according to a lie of a golf ball and controls the main inclination control devices corresponding to the received data to control an inclination of the inclination control plate.

* * * * *